US007614351B2

(12) United States Patent
Piretti

(10) Patent No.: US 7,614,351 B2
(45) Date of Patent: Nov. 10, 2009

(54) FOLDING TABLE

(75) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 543 days.

(21) Appl. No.: 10/480,269

(22) PCT Filed: Jun. 13, 2002

(86) PCT No.: PCT/IT02/00394

§ 371 (c)(1),
(2), (4) Date: Jul. 13, 2004

(87) PCT Pub. No.: WO02/102193

PCT Pub. Date: Dec. 27, 2002

(65) Prior Publication Data

US 2004/0237854 A1 Dec. 2, 2004

(30) Foreign Application Priority Data

Jun. 15, 2001 (IT) ..... TO2001A0577

(51) Int. Cl.
*A47B 3/00* (2006.01)

(52) U.S. Cl. ..... 108/115; 108/1; 248/188.6

(58) Field of Classification Search ..... 108/1, 108/7, 91, 92, 115, 132, 133; 248/188.6, 248/166, 434, 439

See application file for complete search history.

(56) References Cited

U.S. PATENT DOCUMENTS

| | | | | | |
|---|---|---|---|---|---|
| 4,180,002 | A | * | 12/1979 | Huempfner | 108/6 |
| 4,879,954 | A | * | 11/1989 | Sawamura et al. | 108/1 |
| 4,986,195 | A | * | 1/1991 | Diffrient | 248/188.6 |
| 5,638,761 | A | * | 6/1997 | Berkowitz et al. | 108/133 |
| 5,927,214 | A | * | 7/1999 | Schwartz et al. | 108/115 |
| 6,192,808 | B1 | | 2/2001 | Bue | |
| 6,336,414 | B1 | * | 1/2002 | Stewart et al. | 108/115 |

FOREIGN PATENT DOCUMENTS

| | | | |
|---|---|---|---|
| CH | 681 269 | | 2/1993 |
| DE | 42 30 381 | | 4/1993 |
| JP | 2000060646 | * | 2/2000 |
| WO | WO 00/13548 | | 3/2000 |

* cited by examiner

*Primary Examiner*—Hanh V Tran
(74) *Attorney, Agent, or Firm*—Andrus, Sceales, Starke & Sawall, LLP

(57) ABSTRACT

A folding table includes a base structure (12) and a resting surface (14) mounted upon the base structure (14). The resting surface oscillates between a substantially vertical inoperative position, and a substantially horizontal operative position. The resting surface (14) is mounted so that it can oscillate with respect to the base structure (12) about a first horizontal axis (26). The base structure (12) includes a retention device (38), which has at least one articulation arm (40) articulated to the base structure (12) about a second horizontal axis (30) parallel to the first axis (26), and a connection member (42, 142) operatively set between said arm (40) and the resting surface (14).

17 Claims, 15 Drawing Sheets

Fig. 5
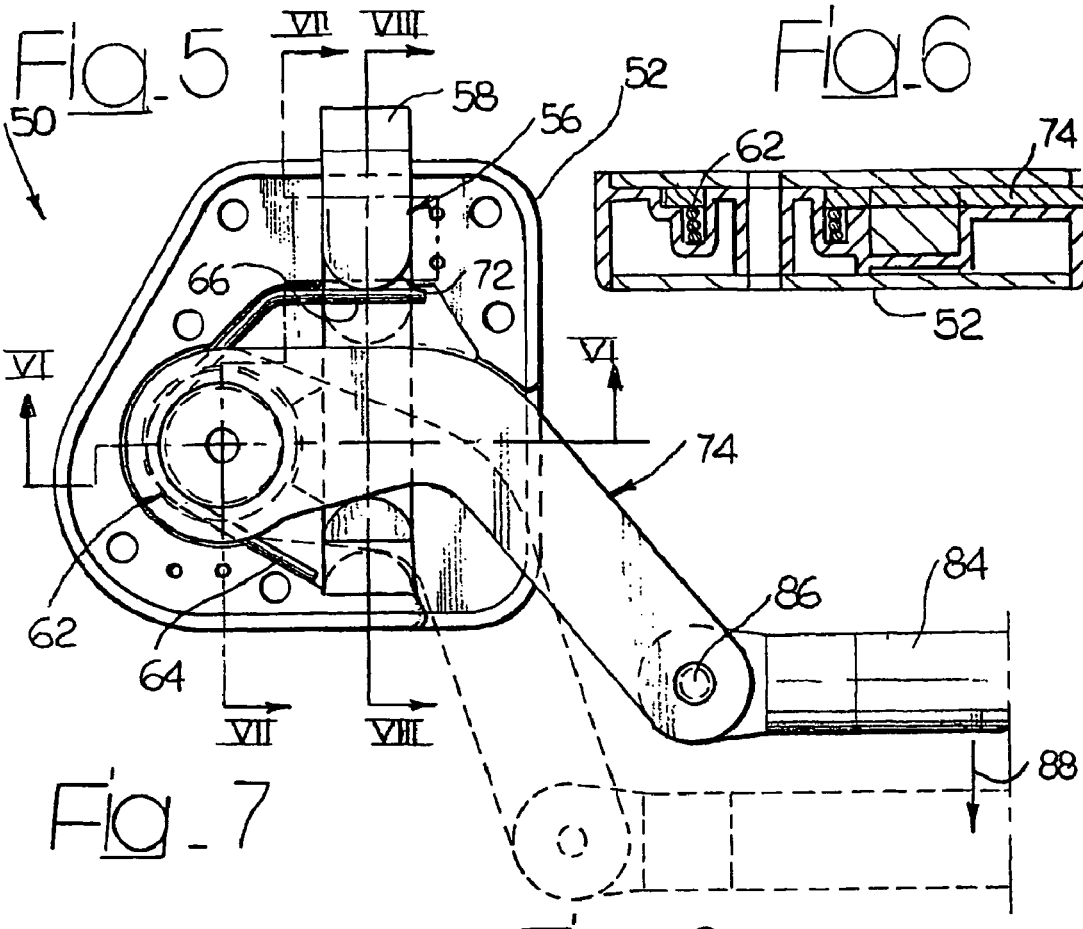
Fig. 6
Fig. 7
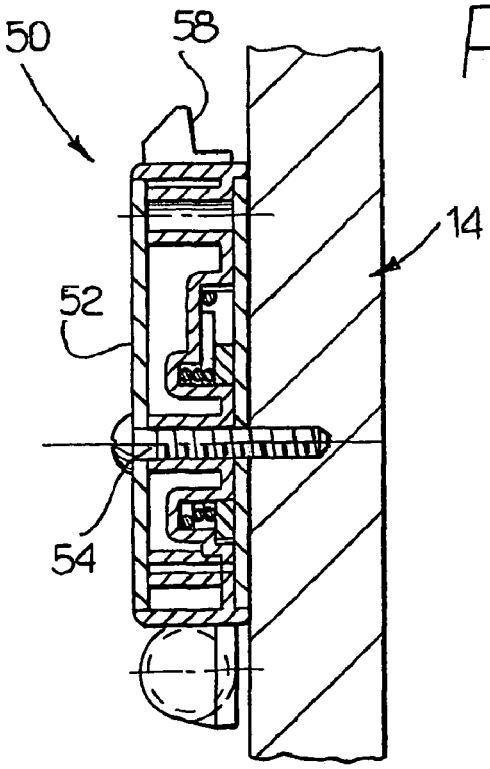
Fig. 8
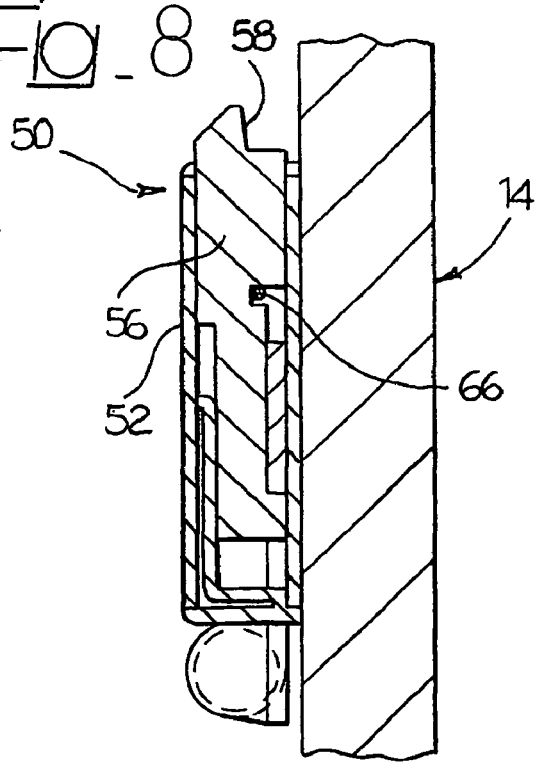

FOLDING TABLE

The present invention relates to a folding table comprising a basic structure and a resting surface mounted on the basic structure with the possibility of oscillating between a substantially vertical inoperative position and a substantially horizontal operative position.

The purpose of the present invention is to provide a particularly simple mechanism which will enable control of displacement of the resting surface between the inoperative position and the operative position. A further purpose of the present invention is to provide a folding table which, in its inoperative position, can be slid into other tables of the same type, in order to reduce to the minimum the space occupied.

According to the present invention, the above and other purposes are achieved by a folding table having the characteristics that form the subject of the ensuing claims.

The present invention will now be described in detail, with reference to the attached drawings, which are provided purely by way of non-limiting example and in which.

Figure 1:
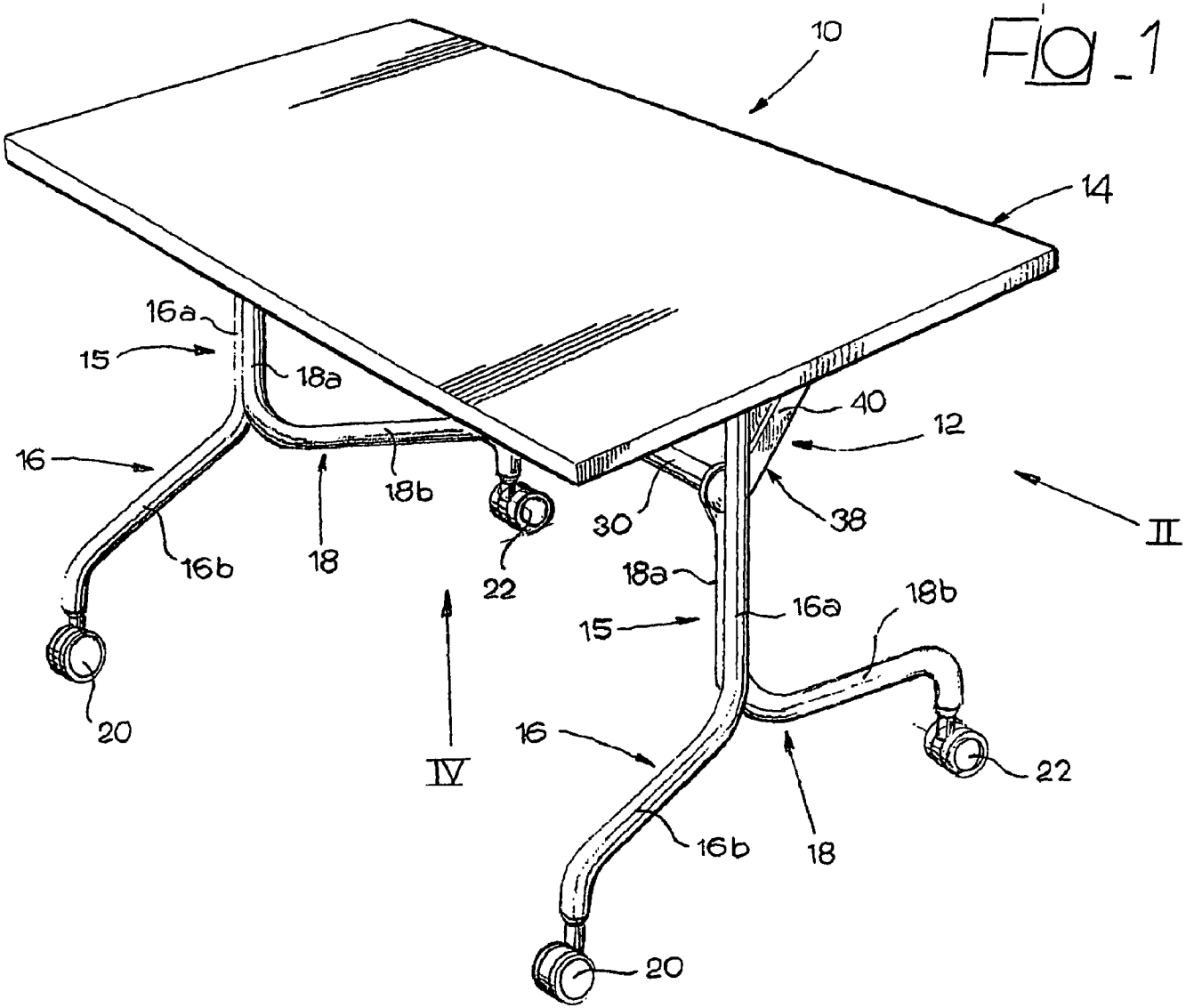
FIG. 1 is a perspective view of a table according to the present invention, in the operative position.
Figure 2:
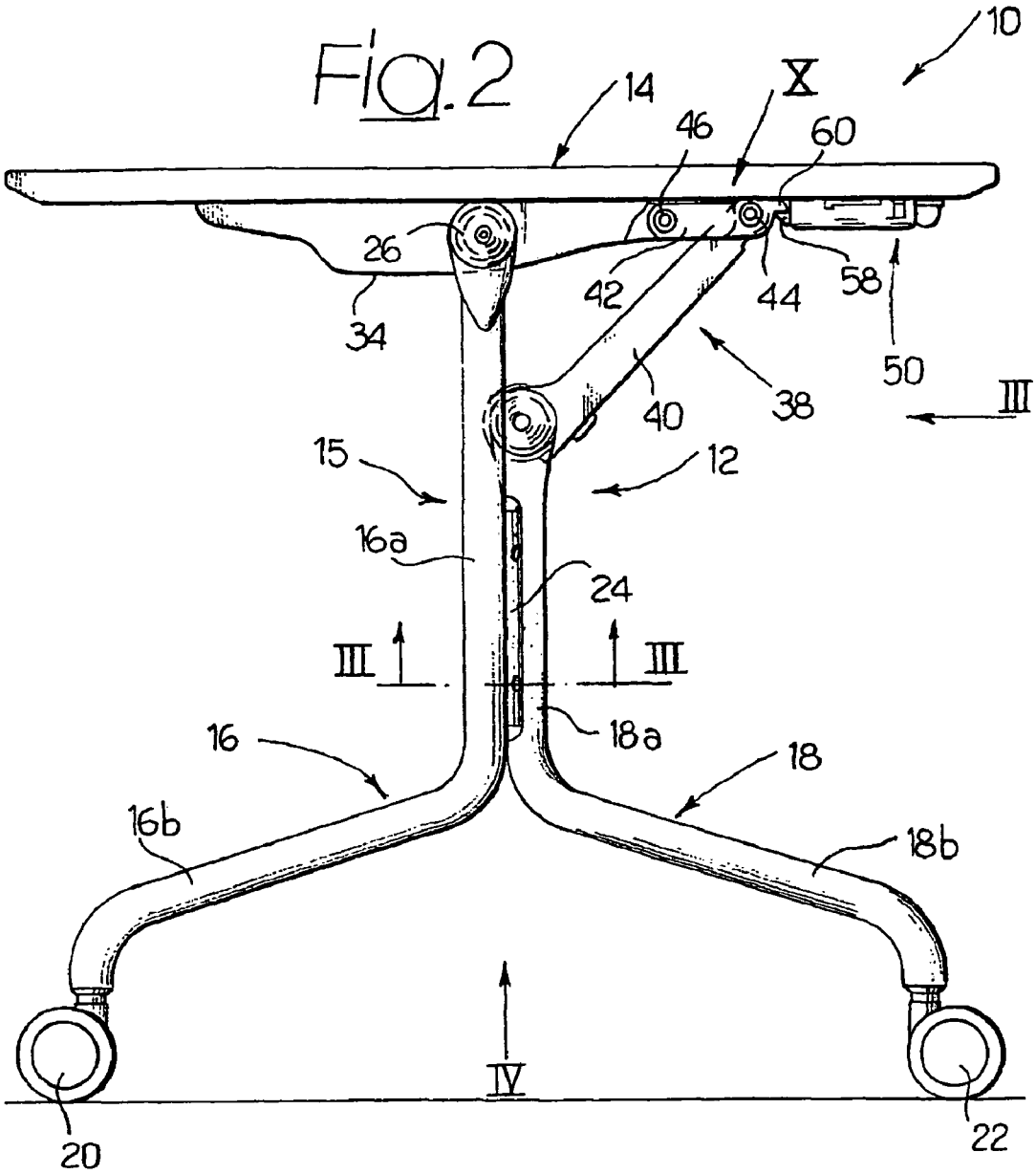
FIG. 2 is a side view in the direction indicated by the arrow II of FIG. 1.
Figure 3A:
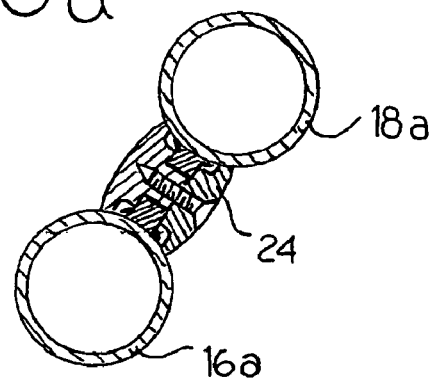
FIG. 3 is a front view in the direction indicated by the arrow III of FIG. 2.
Figure 4:
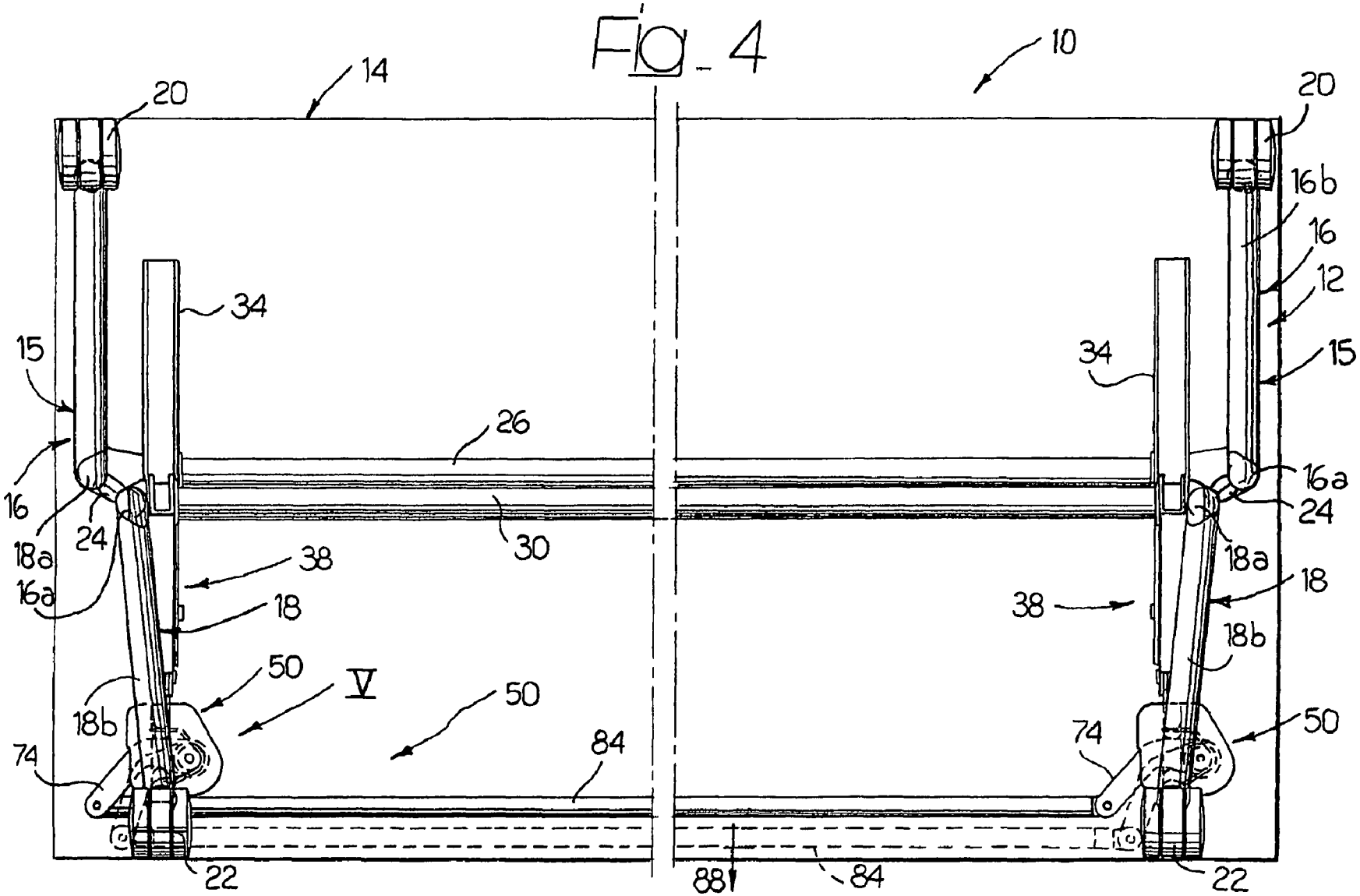
Figure 9:
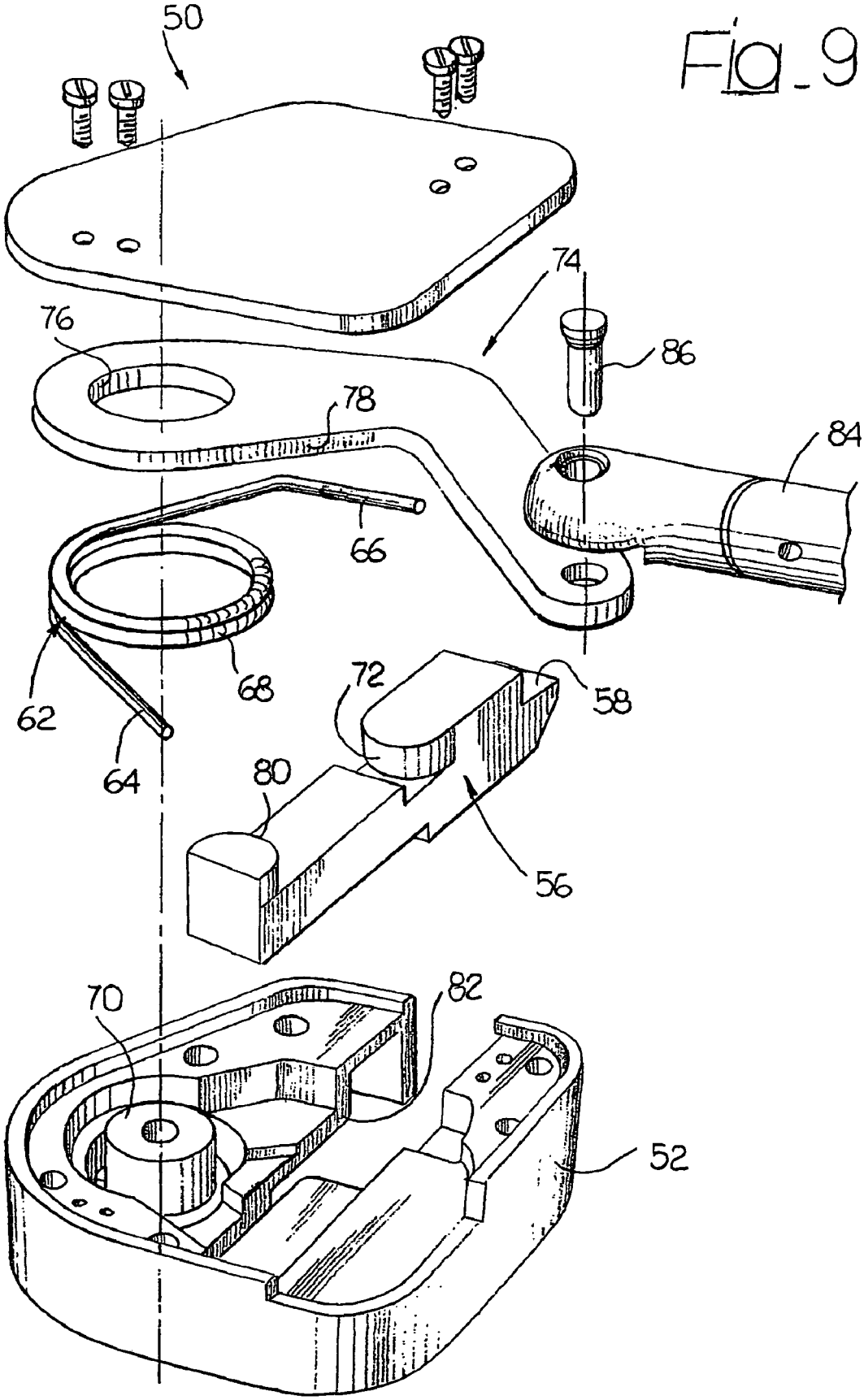
Figures 10, 11:
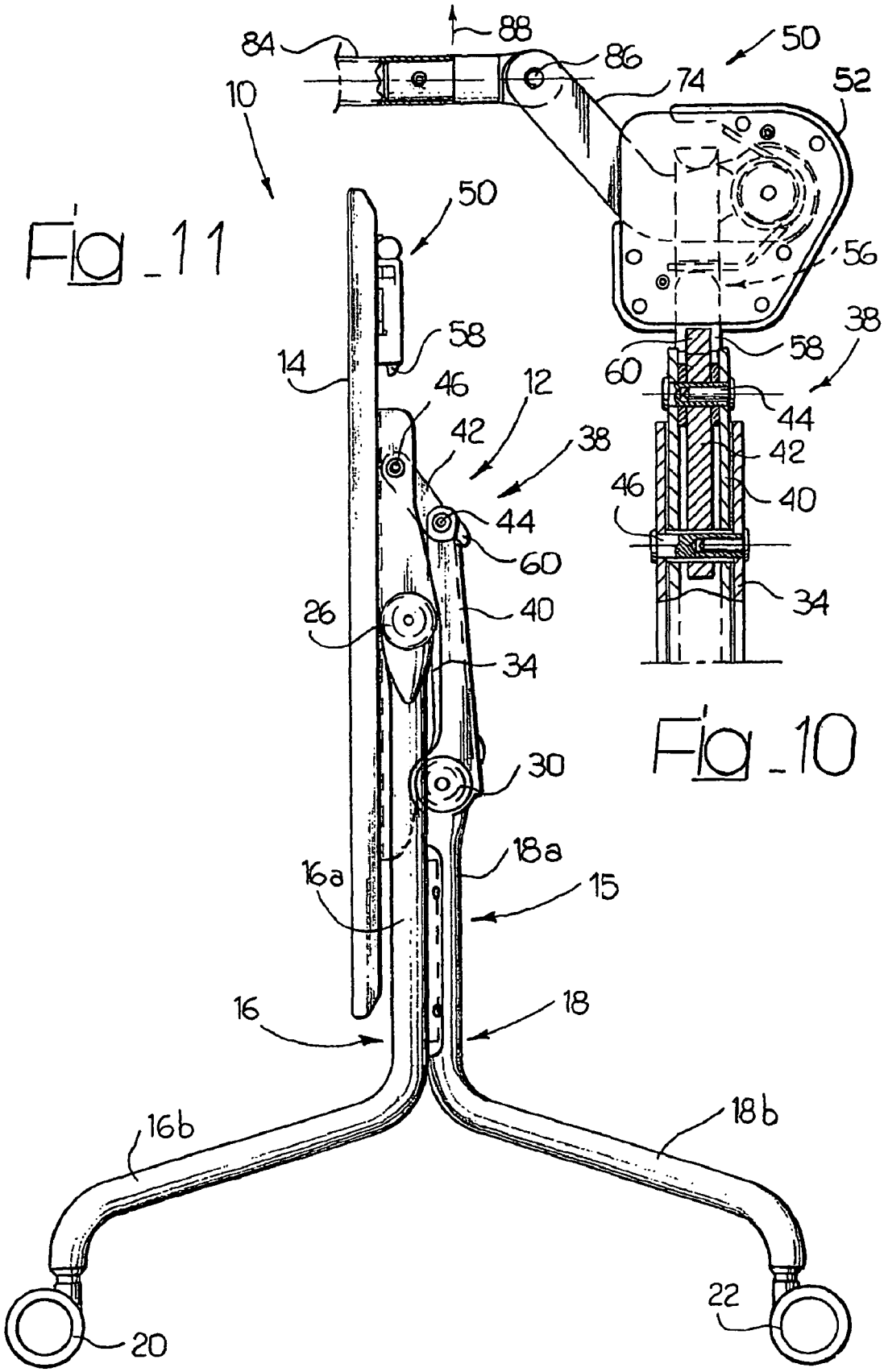
Figure 12:
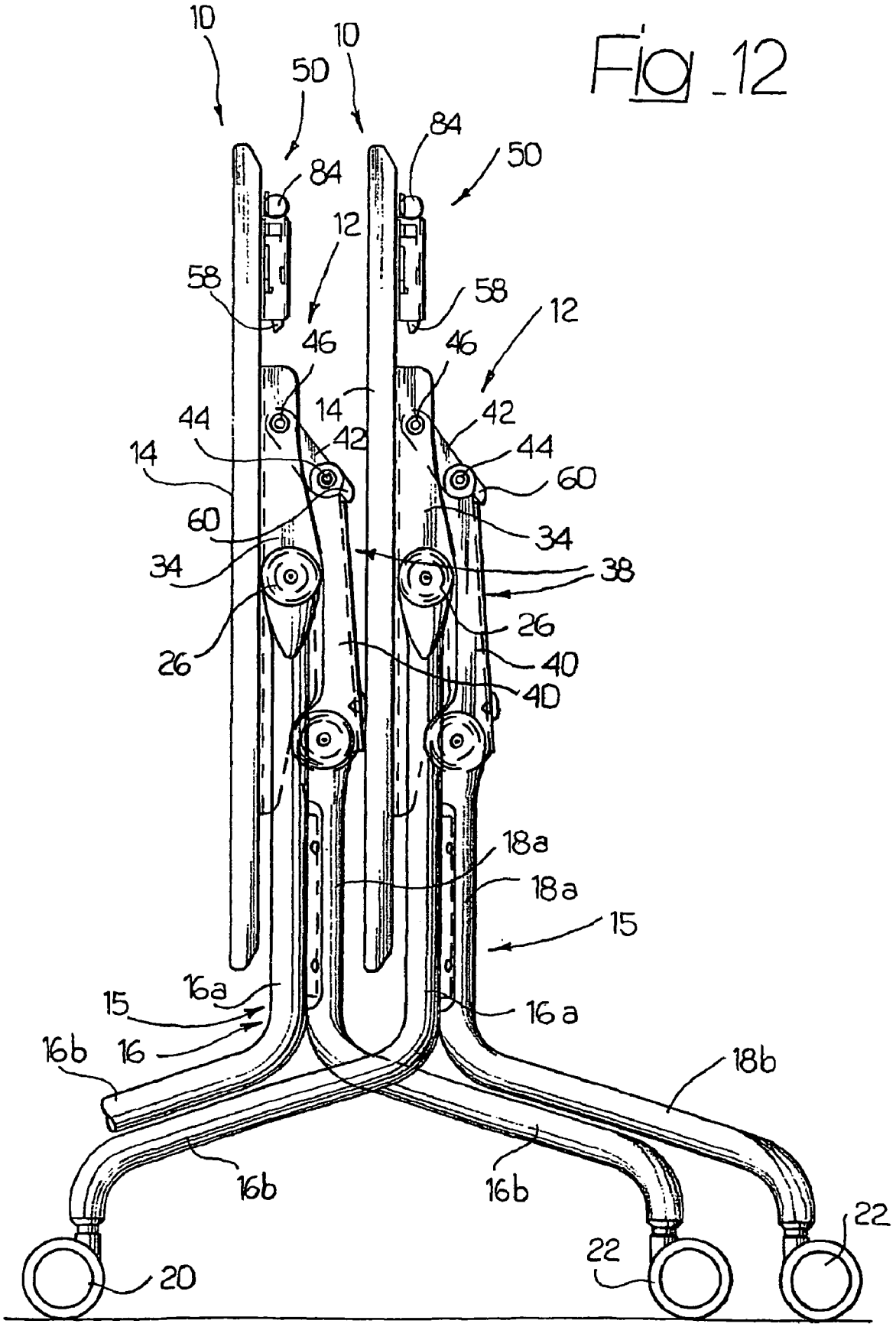
Figure 13:
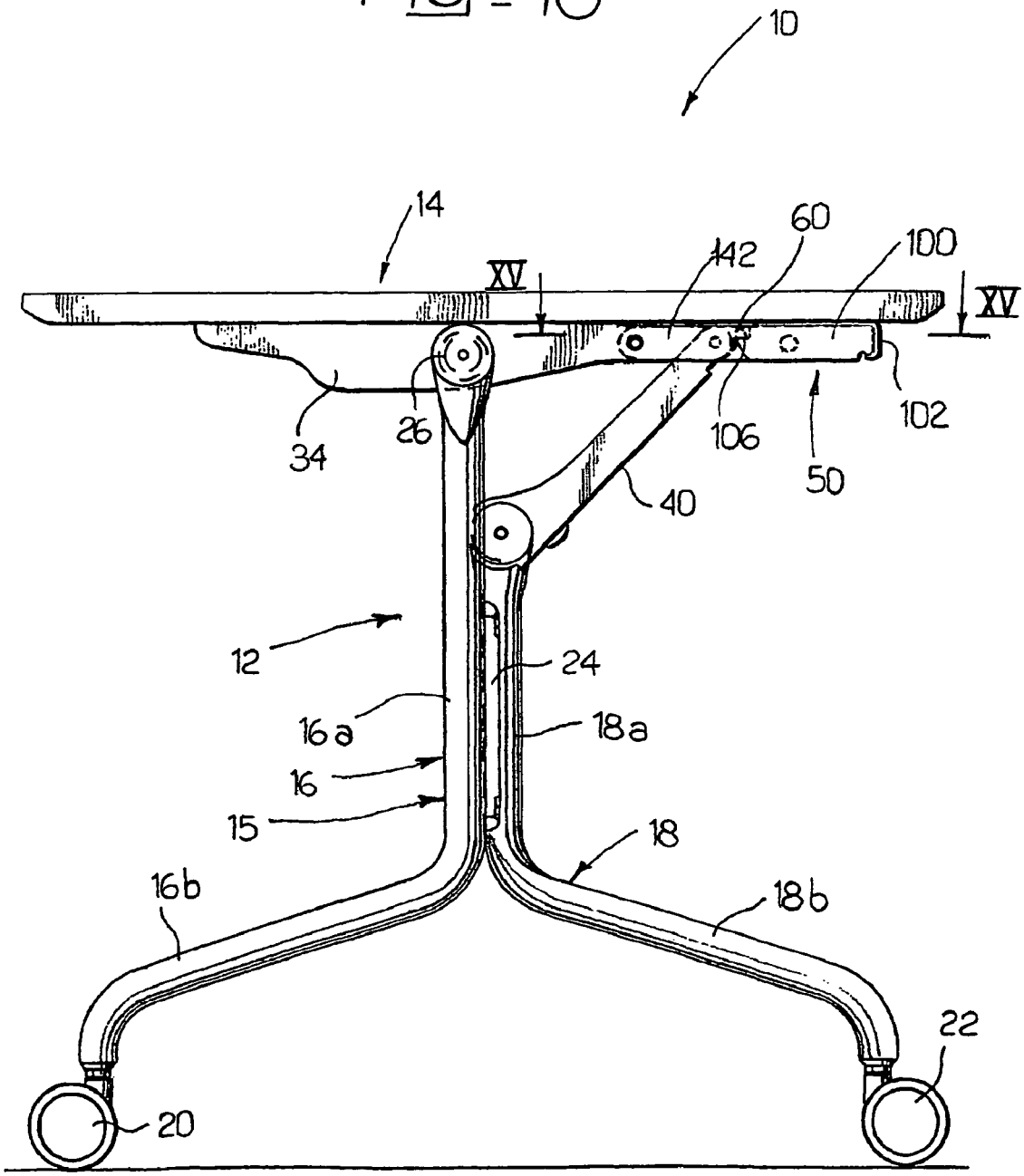
Figure 14:
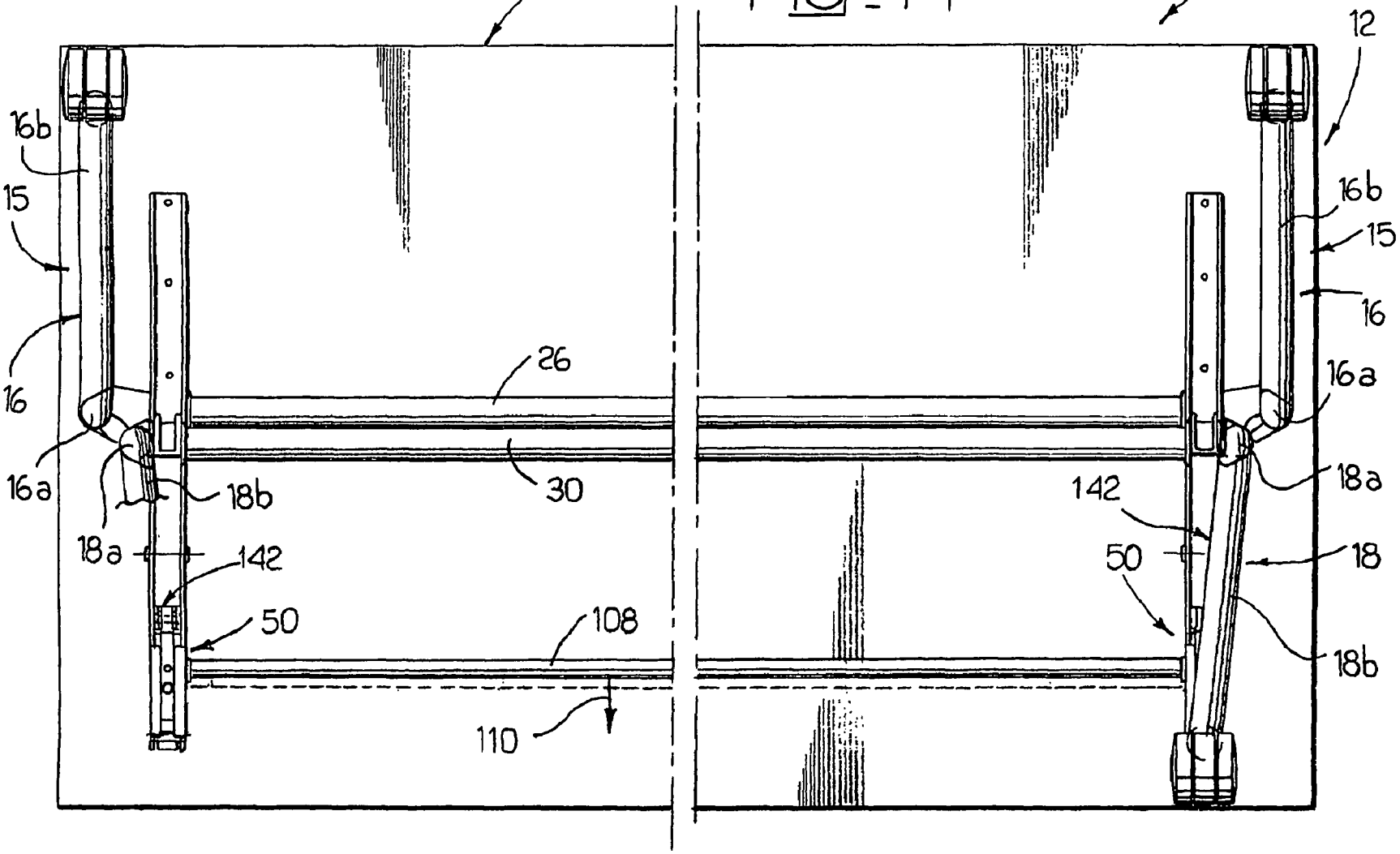
Figure 15:
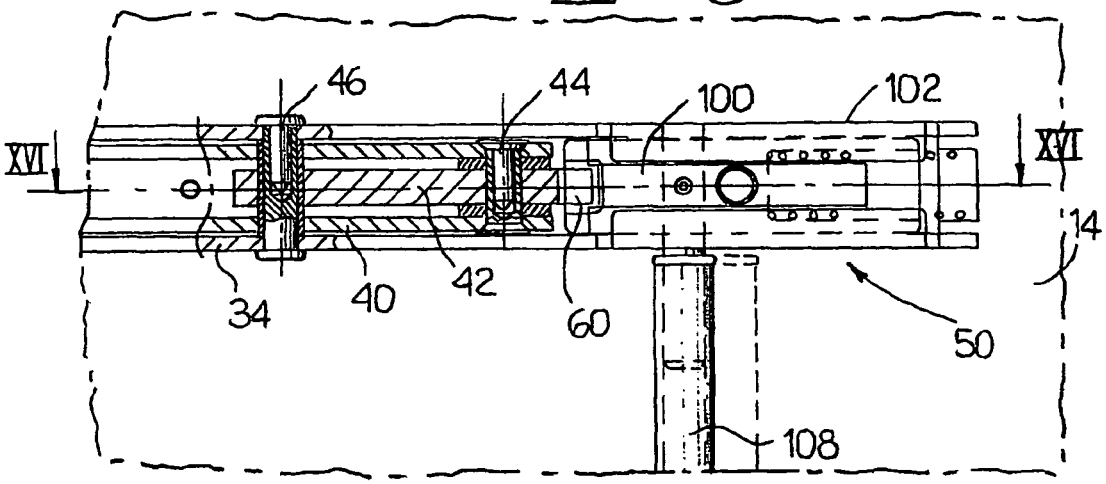
Figure 16:
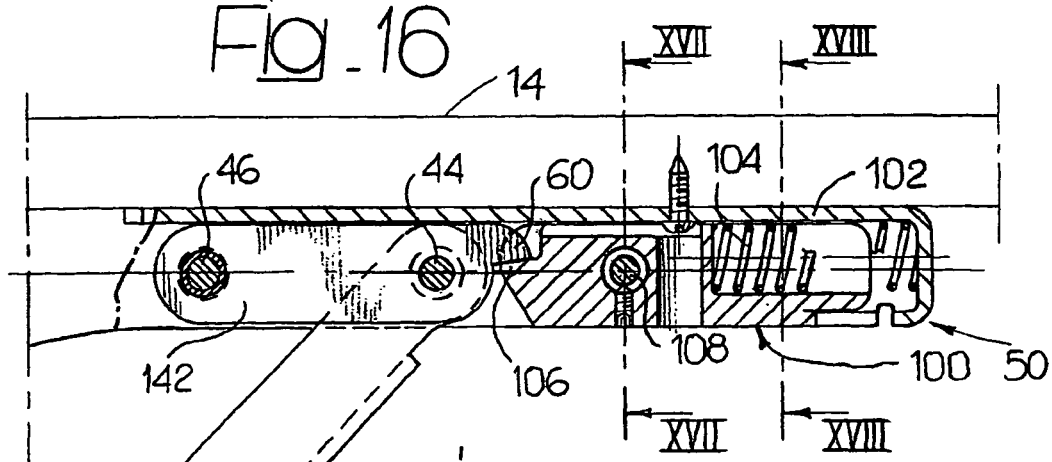
Figure 17:
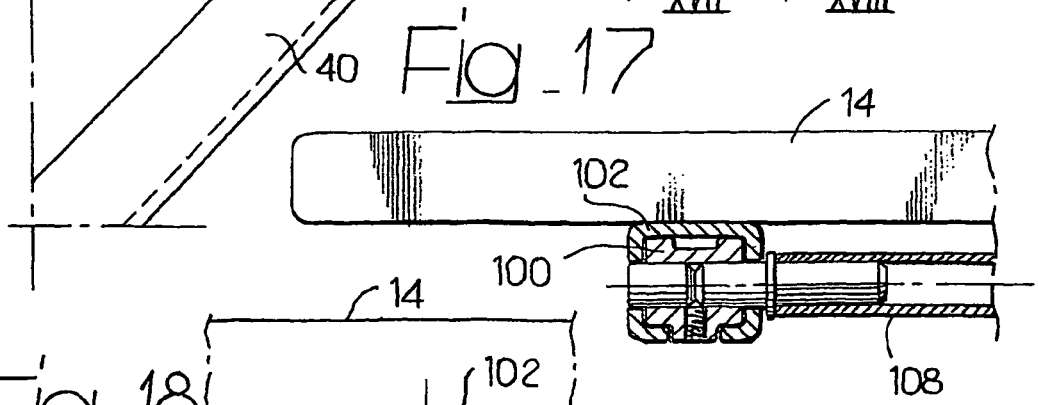
Figure 18:
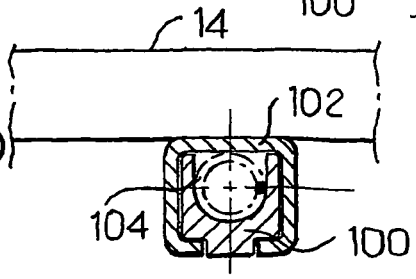
Figure 19:
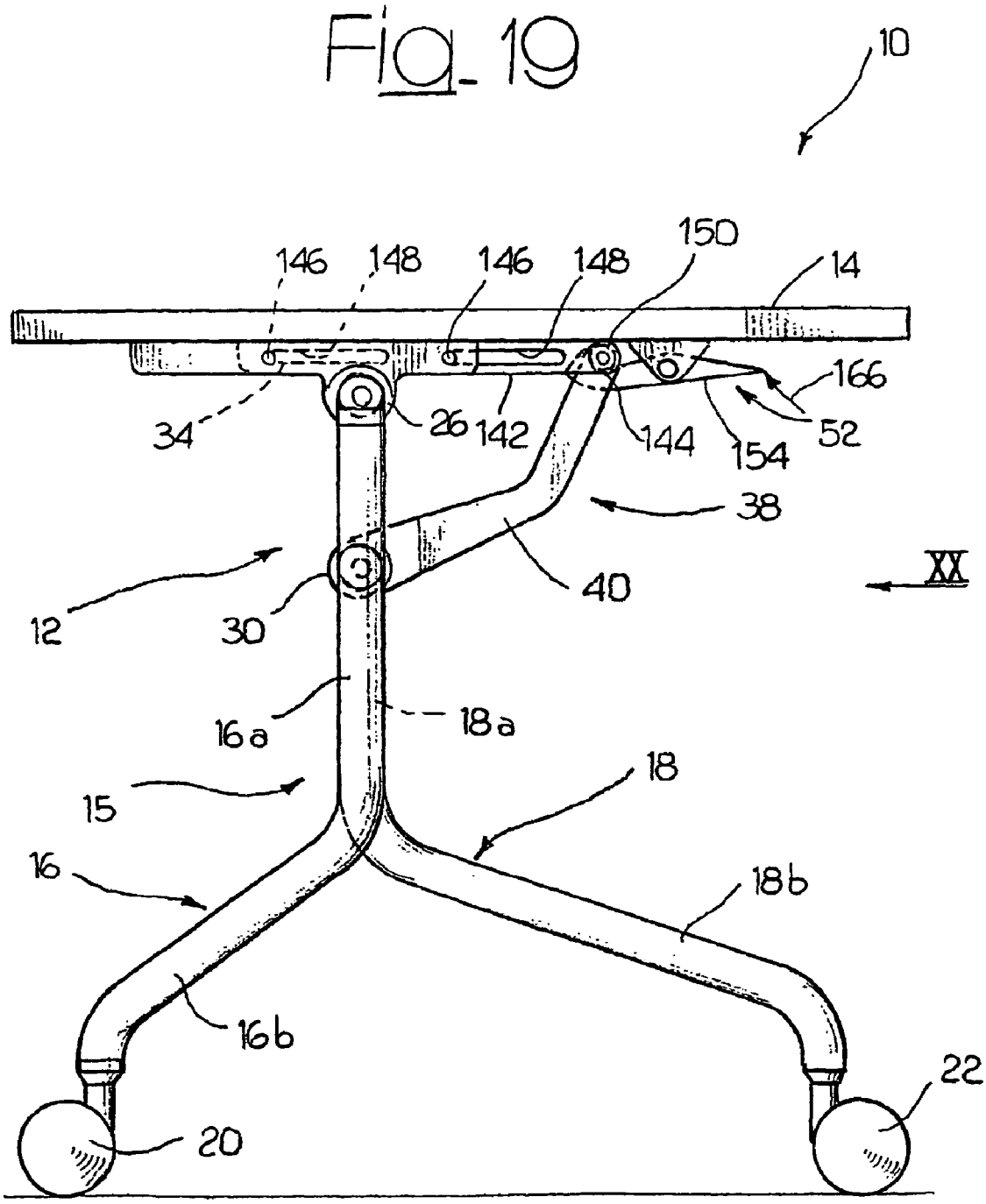
Figure 20:
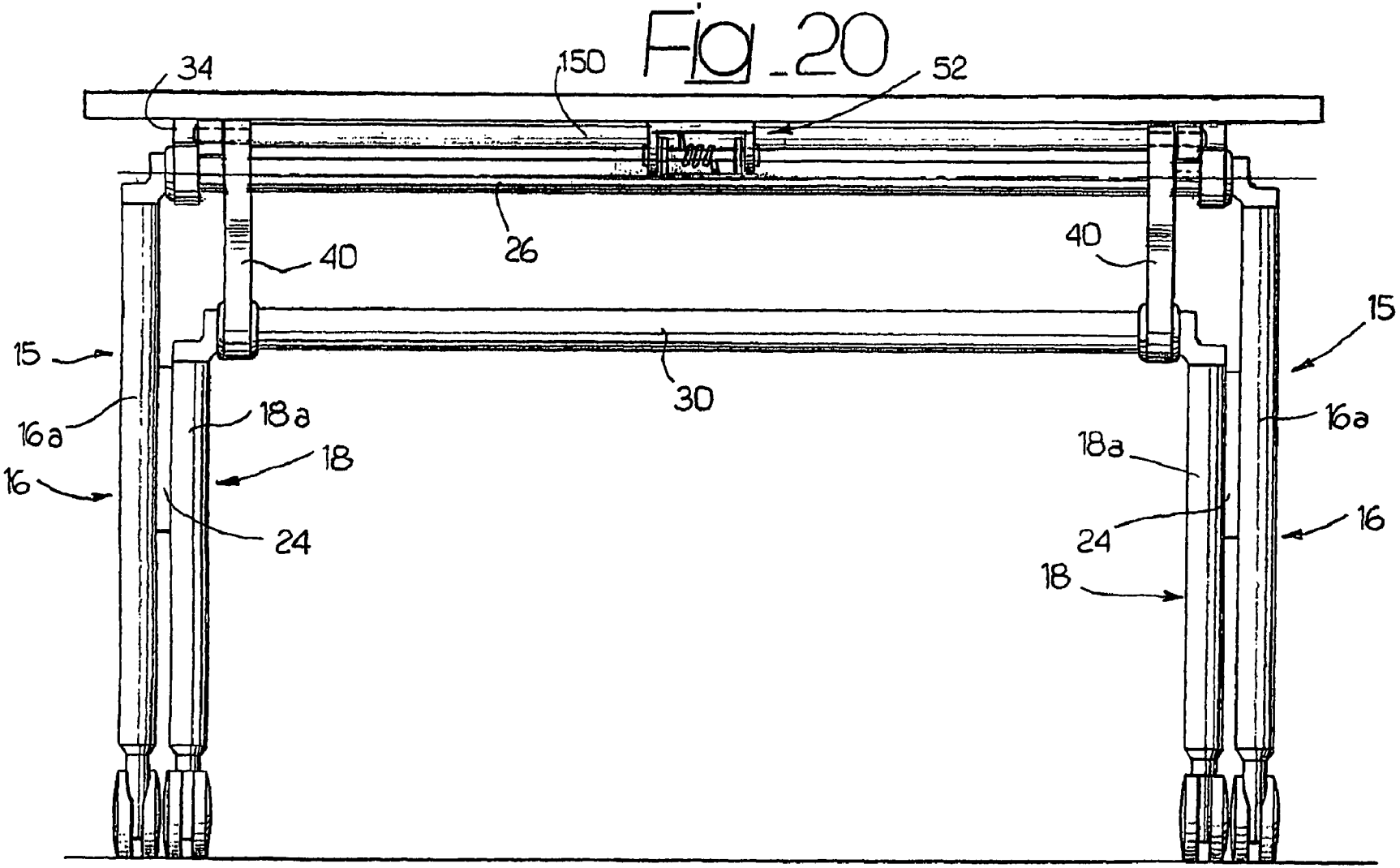
Figure 21:
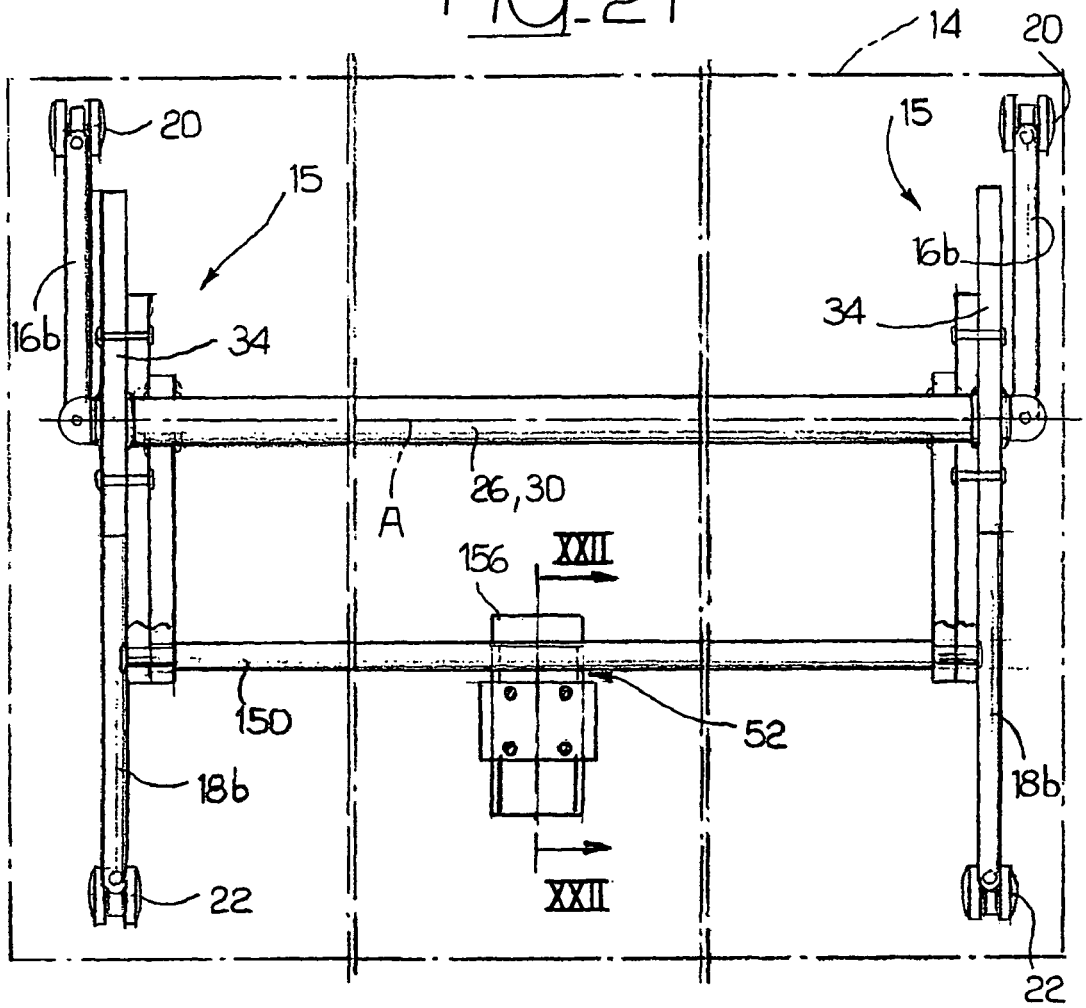
Figure 22:
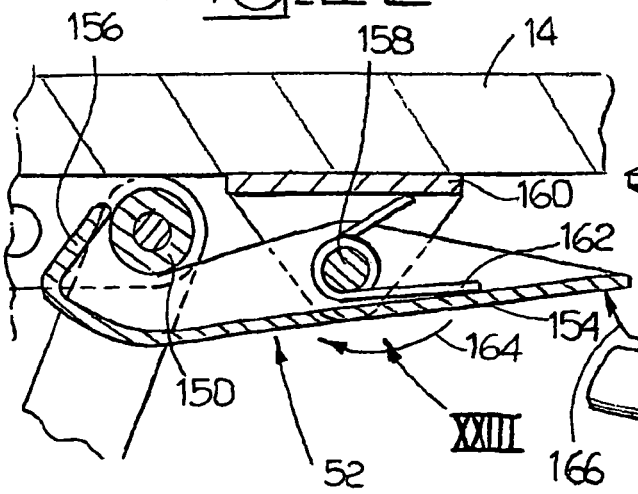
Figure 23:
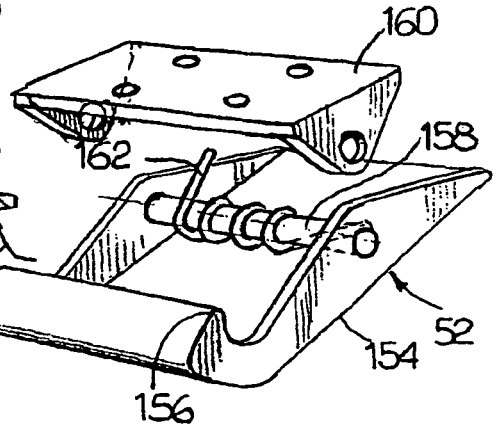
Figure 24:
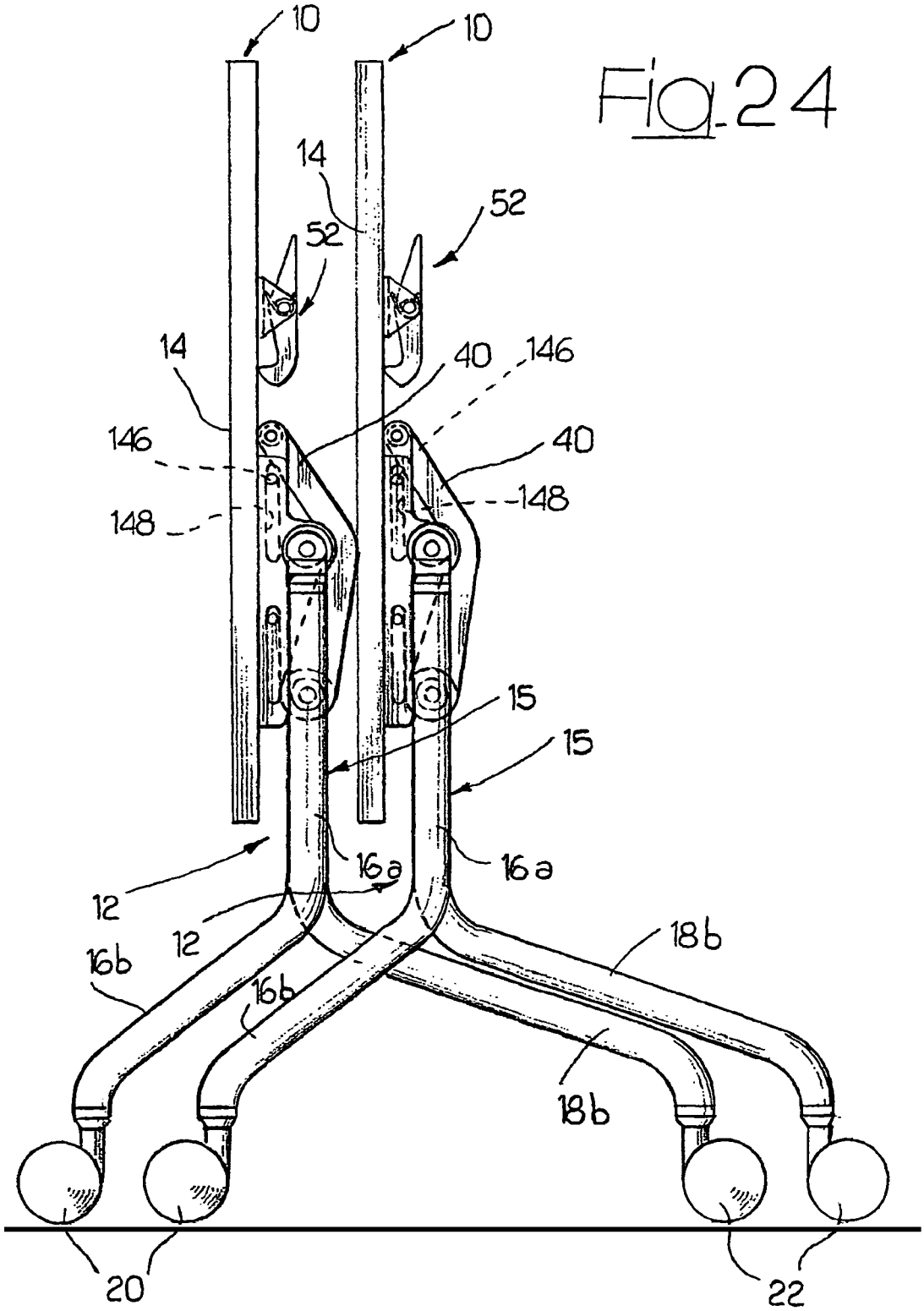

FIG. 3*a* is a cross section taken along the line III-III of FIG. 2;

FIG. 4 is a plan view from beneath in the direction indicated by the arrow IV of FIG. 1;

FIG. 5 is a view at an enlarged scale of a clamping device indicated by the arrow V in FIG. 4;

FIGS. 6, 7 and 8 are cross sections taken, respectively, along the lines VI-VI, VII-VII and VIII-VIII of FIG. 5;

FIG. 9 is an exploded perspective view of the clamping device of FIG. 5;

FIG. 10 is a partially sectioned plan view of the part indicated by the arrow X in FIG. 2;

FIG. 11 is a side view illustrating the table of FIG. 1 in the inoperative position;

FIG. 12 illustrates two tables according to the present invention, which are set up against one another, in the inoperative position;

FIG. 13 is a side view of a variant of the table according to the present invention;

FIG. 14 is a plan view from beneath of the table of FIG. 13;

FIG. 15 is a cross section taken along the line XV-XV of FIG. 13;

FIG. 16 is a cross section taken along the line XVI-XVI of FIG. 13;

FIGS. 17 and 18 are cross sections taken, respectively, along the lines XVII-XVII and XVIII-XVIII of FIG. 16;

FIG. 19 a side view of a second variant of the table according to the present invention;

FIG. 20 is an elevation in the direction indicated by the arrow XX in FIG. 19;

FIG. 21 is a plan view from beneath of the table of FIG. 19;

FIG. 22 is a cross section taken along the line XXII-XXII of FIG. 21;

FIG. 23 is a perspective view of the device indicated by the arrow XXIII of FIG. 22; and FIG. 24 is a side view illustrating two tables according to the variant of FIG. 19, in the inoperative position and set up against one another.

With reference to FIGS. 1 to 12, the number 10 designates a folding table according to a first embodiment of the present invention. The table comprises a basic structure, designated as a whole by 22, carrying a resting surface 14, which can be moved between a substantially vertical inoperative position, illustrated in FIGS. 11 and 12, and a substantially horizontal operative position, illustrated in FIGS. 1 to 4.

The basic structure 12 of the table 10 comprises two supporting assemblies 15 which are the same as one another and set on opposites sides of the table 10. Each of the two supporting assemblies 15 comprises two legs 16, 18 fixed to one another. Each leg 16, 18 has a vertical or substantially vertical branch 16*a*, 18*a*, radiused at its bottom end to an inclined branch 16*b*, 18*b*. The two inclined branches 16*b* and 18*b* of each supporting assembly 15 extend on opposite sides, i.e., one towards the front part of the table and the other towards the rear part. The inclined branches 16*a*, 16*b* may carry, at their bottom ends, respective wheels 20, 22, preferably of an orientable type.

Figure 3:
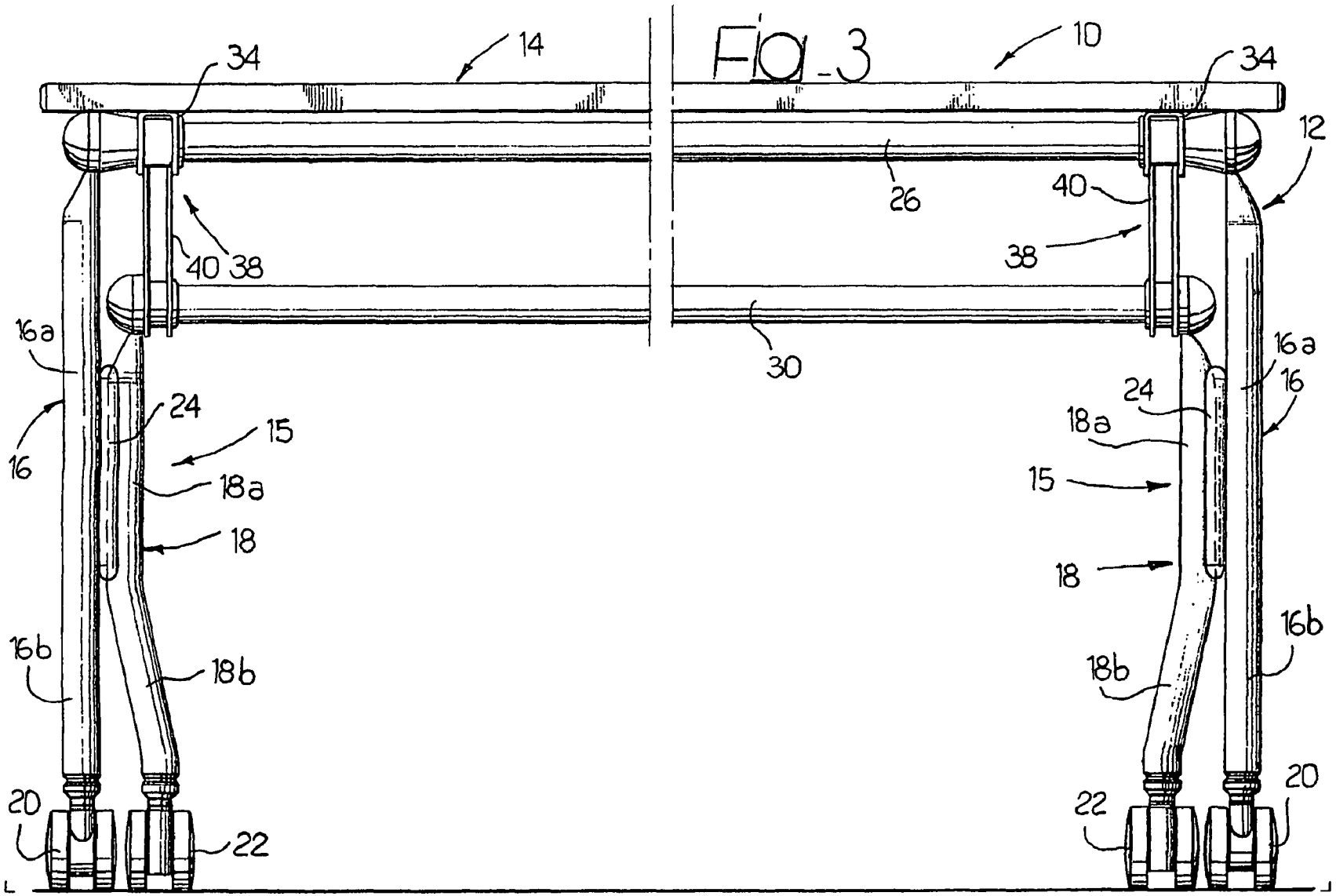

As may be seen, in particular, from FIGS. 2, 3 and 3*a*, the vertical branches 16*a* and 18*a* of the legs 16, 18 are parallel and are fixed to one another by means of a joining profile 24. The rectilinear branches 16*a*, 18*a* are staggered with respect to one another both in the longitudinal direction and in the transverse direction. In particular, the vertical branch 18*a* of the rear leg 18 is displaced inwards and towards the rear part of the table with respect to the rectilinear branch 16*a* of the front leg 16. The two rectilinear branches 16*a*, 18*a* are of different lengths from one another. In particular, the vertical branches 16*a* of the external legs 16 have a length greater than that of the vertical branches 18*a* of the internal legs 18.

The top end of each internal leg is connected to the top end of the other external leg 16 by means of a top transverse element 26, the ends of which are fixed to the legs 16. Likewise, the top ends of the two internal legs 18 are connected to one another by means of a bottom transverse element 30, the ends of which are fixed to the corresponding ends of the internal legs 18. In a plan view (FIG. 4) the two transverse elements 26, 30 partially overlap one another.

The resting surface 14 is mounted so that it can oscillate about the axis of the top transverse element 26. A pair of supports 34 are fixed to the bottom face of the resting surface 14 and are mounted so that they can oscillate about the axis of the top transverse element 26, for example, by means of respective bushings (not illustrated). The supports 34 and the corresponding articulation bushings are preferably set at the ends of the top transverse element 26, in the vicinity of the areas where the said supports are fixed to the external legs 18. Preferably, the two supports 34 are made of metal elements with a channel-shaped cross section.

The resting surface 14 is moreover associated to a retention device 38, which has the purpose of maintaining the resting surface 14 in two stable positions, namely, an operative position, in which the resting surface 14 extends horizontally, and an inoperative position, in which the resting surface 14 extends in a vertical or substantially vertical direction. The retention device 38 comprises a pair of arms 40, each of which has a bottom end articulated to the bottom transverse element 30 about an axis parallel to the axis about which the resting surface 14 is mounted so that it can turn. Preferably, the articulation arms 40 are mounted so that they can turn about the bottom transverse element 30 and are set at corresponding ends of said element, in the vicinity of the top ends of the internal legs 18. The retention device 38 further comprises a pair of connection members 42, each of which is operatively set between an end of the arm 40 and the support 34 fixed to the resting surface 14. In the embodiment of the invention illustrated in FIGS. 1 to 11, the connection members 42 consist of connection rods, each of which has a first end articulated to a respective arm 40 and a second end articulated to a respective support 34. FIG. 10 illustrates a detail of a non-limiting preferred embodiment of the retention device 38. According to this embodiment, each arm 40 has, in cross section, a channel-shaped profile, and the connection rod 42 is set between the two parallel arms of the channel-shaped section. A first pin 44 is provided for articulating the connection rod 42 to the articulation arm 40, and a second pin 46 articulates the connection rod 42 to the support 34.

As can be seen from a comparison between FIGS. 2 and 11, the retention device 38 holds the resting surface 14 stably in an operating position, in which the resting surface 14 is horizontal (see FIG. 2), and in an inoperative position, in which the resting surface 14 is vertical (see FIG. 11). The resting surface 14 can be freely displaced from one to the other of said positions simply by causing the resting surface 14 to rotate about its own axis of articulation. The retention device 38 is shaped so as to define two end-of-travel positions corresponding to the two positions, the operative one and the inoperative one. In particular, a first end-of-travel position is reached in the condition in which the connection rods 42 extend parallel to the resting surf ace 14 (FIG. 2). In the said condition, the geometry of the retention device 38 prevents any further rotation of the resting surface 14 in the clockwise direction as viewed in FIG. 2. A second end-of-travel position is defined by the point where the articulation arms 40 bear upon the top transverse element 26 (FIG. 11). In the latter condition, the device 38 prevents any further rotation of the resting surface 14 in the counterclockwise direction as viewed in FIG. 11. The resting surface 14 will, therefore, be able to oscillate only between the two extreme positions illustrated in FIGS. 2 and 11.

With reference to FIG. 12, according to a particularly advantageous characteristic of the present invention, two tables 10 of the same type, when in an inoperative position, can be slid into one another. In the position where they are slid into one another, the inclined portions 16*b*, 18*b* of a first table are set respectively above and below the corresponding inclined portions 16*b* and 18*b* of a second table set up against the first one. As can be seen in FIG. 12, this possibility of sliding the tables into one another makes for a considerable saving in terms of space required for storing a plurality of tables when they are not being used.

According to a preferred embodiment of the present invention, the table 10 is provided with a clamping device 50 for clamping the resting surface 14 in the operative position.

FIGS. 5 to 9 present a first embodiment of the clamping device 50. This device comprises a body 52 fixed to the bottom face of the resting surface 14, for instance by means of screws 54. The clamping device 50 comprises a catch 56 that can move with respect to the body 52 between a clamped position and a released position. The catch 56 has an engagement tooth 58 which co-operates with a corresponding engagement tooth 60 formed at one end of a corresponding connection rod 42. The clamping device 50 comprises a spring 62 which pushes the catch 56 towards the clamping position. The spring 62 is preferably provided with two arms 64, 66 and a plurality of turns 68. In this embodiment of the invention, the spring 62 is set with the turns 68 wound around a pin element 70 of the shell or casing 52, with a first arm 64 which rests against the casing 52 and a second arm 66 which pushes against a surface 72 of the catch 56. The clamping device 50 comprises a disengagement lever 74 articulated to the casing 52. Preferably, the lever 74 has a hole 76 at one of its ends, which engages the pin element 70 itself so that the latter can turn. Mounted around the pin element 70 is the spring 62. The lever 74 has an active surface 78, which co-operates with one surface 80 of the catch 56, opposite to the surface 72 against which the branch or arm 66 of the spring 62 acts.

With reference to FIG. 5, the spring 62 exerts on the catch 56 an elastic force which pushes the catch towards the clamping position. The catch 56 is slidably mounted in a seat 82 of the casing 52 and can move in a rectilinear direction between an extracted position, corresponding to the clamping position, and a retracted position, corresponding to the disengagement position. In order to bring the catch 56 into the disengagement position, it is sufficient to cause the release lever 74 to oscillate in a clockwise direction as viewed in FIG. 5. This figure shows, by means of a dashed line, the position of the lever 74 corresponding to the disengagement position of the catch 56. When the lever 74 is released, the spring 62 brings the catch 56 back into the clamping position.

Preferably, the table according to the present invention is provided with two clamping devices 50, each of which is set in a position corresponding to a respective connection rod 42. Each clamping device 50 is set in such a way that, as is illustrated in FIG. 2, the tooth 60 of each connection rod 42 engages the tooth 58 of the respective catch when the resting surface 14 is in the operative position. The teeth 58, 60 are shaped in such a way that their relative engagement occurs automatically during rotation of the resting surface 14 into the open position. In practice, during the last phase of the movement of rotation of the resting surface 14 towards the open position, the tooth 60 of each connection rod 42 enters into contact with the bottom side of the corresponding tooth 58 and pushes the catch backwards against the action of the spring. As soon as the resting surface 14 reaches the horizontal operative position, the catch 50, under the action of the spring, moves into the clamping position, in which the two teeth 58, 60 are mutually engaged. In this position, the two connection rods 42 are constrained so that they remain parallel to the resting surface 14. It will be appreciated that, with the connection rods 42 engaged by the clamping devices 50, the articulation arms 40 are not able to rotate, and the resting surface 14 is clamped in the operative position.

Preferably, the levers 74 of the two clamping devices 50 are connected to each other by means of a release bar 84. As is illustrated in FIGS. 5 and 9, each end of the release bar 84 is articulated to a corresponding end of a lever 74 about an axis parallel to the axis of articulation of the lever 74, for example, by means of a pin 86. As is illustrated in FIG. 5, by exerting a tensile force on the release bar 84 in the direction indicated by the arrow 88, rotation of both of the release levers 74 is obtained and the simultaneous disengagement of both the catches 58. Hence, in order to cause the resting surface 14 to rotate towards the inoperative position, the user must simply pull the release bar 88 to disengage the catches and cause the resting surface 14 to rotate towards its inoperative position.

FIGS. 13 to 18 illustrate a second embodiment of the present invention. The items that correspond to the ones previously described are designated by the same reference numbers. The version of the table shown in FIGS. 13 to 18 differs from the one previously described only as regards the way the clamping device is made. With reference to FIGS. 15 to 18, the clamping device 50 comprises a catch 100, which is mounted so that it can slide in a rectilinear direction in a guide made of sectional strip 102 fixed to the resting surface 14. A helical compression spring 104 is set between the catch 100 and the guide made of sectional strip 102 and exerts on the catch 100 an elastic force that tends to push it towards the clamping position. The catch 100 is provided with an engagement tooth 106, which co-operates with a corresponding engagement tooth 60 of the connection rod 42. Also in this embodiment, as illustrated in FIG. 14, there are preferably provided two clamping devices 50, each of which is set in a position corresponding to a respective connection rod 42. A release bar 108 is provided for controlling simultaneous disengagement of both the catches 100 of the two release devices 50. The release bar 108 is fixed at its ends to two catches 100, as is illustrated, for example, in FIG. 17. The release bar 108 is mobile in the direction indicated by the arrow 110 in FIG. 14 in order to bring the two catches 100 into the disengagement position. As soon as the user releases the release bar 108, the springs 104 bring the catches 108 back into the clamping position. Also in this case, the catches 100 automatically engage the connection rods 42 when the resting surface 14 reaches its horizontal operative position.

FIGS. 19 to 24 illustrate a third embodiment of the table according to the present invention. The items corresponding to the ones described previously are designated by the same reference numbers.

In this third embodiment, the basic structure 12 of the table comprises, as described previously, a retention device 38 comprising a pair of articulation arms 40 articulated to a bottom transverse element 30. In this embodiment, each retention device 38 comprises a pair of slidable-connection members 142, which replace the connection rods 42 of the previous embodiments. Each slidable-connection member 142 is articulated at one end 144 of the respective articulation arm 40 about an axis parallel to the axis of articulation of the arms 40. Each slidable-connection member engages a respective support 34 slidably along a direction parallel to the resting surface 14. The slidable-connection member 142 is constrained to move with respect to the resting surface 14 in a rectilinear direction parallel to the resting surface 14 and orthogonal to the axis of articulation of the resting surface 14 of the basic structure 12. In the embodiment schematically illustrated in the figures, each slidable-connection member 142 is provided with a pair of slits 148, which are engaged by respective pins 146 carried by the respective support 34. Engagement between the pin 146 and the slit 148 defines two end-of-travel limit positions of the slidable-connection member 142 with respect to the support 34. The two end-of-travel positions of the slidable-connection member 142 correspond, respectively, to the operative position illustrated in FIG. 19 and to the inoperative position illustrated in FIG. 24. Preferably, the top ends 144 of the two articulation arms 40 are connected to one another by means of a transverse element 150, about which the ends of the slidable-connection members 142 are articulated.

Also in this embodiment of the invention a clamping device 50 is provided for clamping the resting surface 14 in the operative position. The clamping device 50 can be made as in the embodiments previously described or as illustrated in FIGS. 19 to 24 and, in particular, in FIGS. 22 and 23. With reference to the said figures, the clamping device 50 comprises a lever 154 having a portion shaped like a hook 156, designed to hook the transverse tubular element 150. The lever 154 is articulated to the resting surface 14 by means of a pin 158 parallel to the axis of articulation of the resting surface 14 and carried by a flange 160 fixed to the bottom face of the resting surface 14. An elastic element 162 tends to cause the lever 154 to rotate in the direction indicated by the arrow 164 and to maintain the said lever 154 in an engagement position.

As is illustrated in FIGS. 19, 21 and 22, when the resting surface 14 is in the operative position, the transverse element 150, which joins the ends of the arms 140 together, is engaged with the hook-shaped end 156 of the lever 154. In this condition, the resting surface 14 is clamped in a stable position and cannot rotate about its axis of articulation. In order to set the resting surface 14 in its substantially vertical inoperative position, the user acts on the lever 154 in the direction indicated by the arrow 166. The lever 154 rotates about the pin 158, and the hook-shaped portion 156 disengages from the transverse element 150. At this point, the resting surface 14 is free to rotate about its own axis of articulation. The arms 40 and the connection members 142 guide the movement of rotation of the resting surface 14 about its own axis of articulation and withhold the resting surface 14 in the inoperative position illustrated in FIG. 24. Also in this embodiment, two tables of the same type can be slid into one other as illustrated in FIG. 24.

The table according to the present invention may undergo variations, without thereby departing from the scope of the invention. For example, the retention device 28 could be provided with just one articulation arm 40 for a narrow resting surface, or else more than two articulation arms could be provided for a wider resting surface.

The invention claimed is:

1. A folding table comprising a base structure (12) and a resting surface (14) mounted upon the base structure (12), wherein said resting surface oscillates between an upright inoperative position, and a substantially horizontal operative position, characterized in that the resting surface (14) is mounted so that it can oscillate with respect to the base structure (12) about a first horizontal pivot axis (26), and in that the aforesaid base structure (12) comprises a retention device (38), which includes: at least one articulation arm (40) articulated to the base structure (12) about a second horizontal pivot axis (30) parallel to the first axis (26); and a connection member (42,142) operatively set between said arm (40) and the aforesaid resting surface (14), wherein said connection member is pivotably interconnected with said arm (40) for movement about a third horizontal pivot axis parallel to the first and second axes, is pivotably interconnected with said resting surface for movement about a fourth horizontal pivot axis parallel to the first, second, and third axes and extends horizontally adjacent an underside of the resting surface when the resting surface is in the horizontal operative position, and wherein the third and fourth horizontal pivot axes lie above the first horizontal pivot axis when the resting surface is in the upright inoperative position.

2. The table according to claim 1, characterized in that said connection member comprises at least one connection rod (42) having a first end articulated to the aforesaid articulation arm (40) for movement about said third pivot axis and a second end articulated to the resting surface (14) for movement about said fourth pivot axis.

3. The table according to claim 1, characterized in that the base structure (12) comprises a pair of supporting assemblies (15), each of which comprises an external leg (16) and an internal leg (18), said legs being arranged so as to enable two tables of the same type to be slid into one another when the respective resting surfaces (14) are in the aforesaid inoperative position.

4. The table according to claim 3, characterized in that each of said legs (16, 18) comprises a vertical portion (16*a*, 18*a*) radiused at its bottom end to an inclined portion (16*b*, 18*b*), said vertical portions (16*a*, 18*a*) being staggered with respect to one another in a direction parallel to the first horizontal axis.

5. The table according to claim 4, characterized in that the two external legs (16) of said supporting assemblies (15) carry the first axis.

6. The table according to claim 5, characterized in that the aforesaid internal legs (18) carry the second axis.

7. The table according to claim 1, further comprising at least one clamping device (50) for clamping the resting surface (14) in the aforesaid operative position.

8. The table according to claim 7, characterized in that said clamping device (50) comprises a catch (56, 100) which is configured to slide in a direction parallel to the resting surface (14) and move between a clamping position and a disengagement position, said catch (56) being associated with elastic means (62, 104), which pushes said catch towards its clamping position.

9. The table according to claim 8, including two clamping devices (50) and two connection members (42), wherein each clamping device (50) is set in a position corresponding to one of the connection members (42), and a transverse release bar (84) for controlling simultaneous disengagement of said catches (56, 100).

10. The table according to claim 7, characterized in that said clamping device (50) comprises a lever (154) designed to engage with a transverse element (150) which pivotably connects together the aforesaid arm (40) and the aforesaid connection member (142).

11. The table according to claim 4, characterized in that the aforesaid inclined portions (16*b*, 18*b*) are designed to be set above or below the corresponding inclined portions of a second table when two or more tables of the same type are set up against one another in the aforesaid inoperative position.

12. A folding table comprising a base structure (12) and a resting surface (14) mounted upon the base structure (12), wherein said resting surface oscillates between an upright inoperative position, and a substantially horizontal operative position, characterized in that the resting surface (14) is mounted so that it can oscillate with respect to the base structure (12) about a first fixed-position horizontal axis (26), and in that the aforesaid base structure (12) comprises a retention device (38), which includes at least one articulation arm (40) articulated to the base structure (12) about a second horizontal axis (30) parallel to the first horizontal axis (26), and a connection member (42, 142) operatively set between said arm (40) and the aforesaid resting surface (14), wherein said connection member is pivotably interconnected with said arm for movement about a third horizontal pivot axis parallel to the first and second axes, is pivotably interconnected with said resting surface for movement about a fourth horizontal pivot axis and extending horizontally adjacent an underside of the resting surface when the resting surface is in the horizontal operative position, wherein the position of the first horizontal axis remains fixed relative to the resting surface during movement of the resting surface between the upright inoperative position and the horizontal operative position, the third and fourth horizontal pivot axes lie above the first horizontal pivot axis when the resting surface is in the upright inoperative position, and further comprising a clamping arrangement carried by the resting surface (14), wherein the clamping arrangement is configured to engage the connection member at a location spaced from the first horizontal axis when the resting surface is in the horizontal operative position.

13. The table according to claim 12, characterized in that said connection member comprises at least one connection rod (42) having a first end articulated to the aforesaid articulation arm (40) for movement about the third pivot axis and a second end articulated to the resting surface (14) for movement about the fourth pivot axis.

14. The table according to claim 12, characterized in that the base structure (12) comprises a pair of supporting assemblies (15), each of which comprises an external leg (16) and an internal leg (18), said legs being arranged so as to enable two tables of the same type to be slid into one another when the respective resting surfaces (14) are in the aforesaid inoperative position.

15. The table according to claim 12, characterized in that said clamping arrangement comprises a catch (56, 100) which is configured to slide in a direction parallel to the resting surface (14) and move between a clamping position and a disengagement position, said catch (56) being associated with elastic means (62, 104), which pushes said catch towards its clamping position.

16. The table according to claim 15, including two catches and two connection members (42), wherein each catch is set in a position corresponding to one of the connection members (42), and a transverse release bar (84) for controlling simultaneous disengagement of said catches.

17. The table according to claim 12, characterized in that said clamping arrangement comprises a lever (154) designed to engage with a transverse element (150) which pivotably connects together the aforesaid arm (40) and the aforesaid connection member (142).

* * * * *

UNITED STATES PATENT AND TRADEMARK OFFICE

CERTIFICATE OF CORRECTION

PATENT NO. : 7,614,351 B2
APPLICATION NO. : 10/480269
DATED : November 10, 2009
INVENTOR(S) : Giancarlo Piretti It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1211 days.

Signed and Sealed this

Nineteenth Day of October, 2010

David J. Kappos

David J. Kappos
*Director of the United States Patent and Trademark Office*